US006040050A

United States Patent [19]

Kitagawa et al.

[11] Patent Number: 6,040,050

[45] Date of Patent: Mar. 21, 2000

[54] POLYBENZAZOLE FIBER HAVING HIGH TENSILE MODULUS AND PROCESS OF MANUFACTURE THEREOF

[75] Inventors: Tooru Kitagawa; Michio Ishitobi, both of Ohtsu, Japan

[73] Assignee: Toyo Boseki Kabushiki Kaisha, Osaka-fu, Japan

[21] Appl. No.: 09/097,997

[22] Filed: Jun. 16, 1998

[30] Foreign Application Priority Data

Jun. 18, 1997 [JP] Japan ..... 9-161554
Oct. 14, 1997 [JP] Japan ..... 9-280789

[51] Int. Cl.[7] ..... B02G 3/00
[52] U.S. Cl. ..... 428/364; 428/394
[58] Field of Search ..... 428/364, 394, 428/395; 264/205

[56] References Cited

U.S. PATENT DOCUMENTS

| | | | |
|---|---|---|---|
| 5,296,185 | 3/1994 | Chau et al. | 264/205 |
| 5,385,702 | 1/1995 | Mills et al. | 264/103 |
| 5,772,942 | 6/1998 | Teramotol | 264/184 |

FOREIGN PATENT DOCUMENTS

| | | | |
|---|---|---|---|
| WO9404726 | 3/1994 | European Pat. Off. . | |
| WO 94/04726 | 3/1994 | WIPO . | |
| WO 94/12702 | 6/1994 | WIPO . | |
| WO 94/12703 | 6/1994 | WIPO | 6/74 |
| WO 94/12705 | 6/1994 | WIPO | 6/74 |
| WO 96/20303 | 7/1996 | WIPO . | |

OTHER PUBLICATIONS

Patent Abstracts of Japan, vol. 97, No. 004, (Toyobo Co. Ltd.), published Oct. 12, 1996, abstract only.

*Primary Examiner*—Newton Edwards

*Attorney, Agent, or Firm*—Morrison & Foerster LLP

[57] ABSTRACT

A polybenzazole fiber obtained through heat treatment, which has a high tensile modulus of not less than 300 GPa and a tensile strength of not less than 5.0 GPa, said fiber being characterized by an X-ray analysis by a fine structure thereof of at least one of the following (1) and (2):

(1) a crystal orientation parameter $<\sin^2\Phi>$ of not more than 0.009 as determined by a wide-angle X-ray diffraction method, (2) absence of an equatorial streak, a two-point pattern or a four-point pattern in a small-angle X-ray scattering; and a process of manufacturing a polybenzazole fiber which comprises extruding a dope comprising a polybenzazole polymer and a nonoxidative acid capable of dissolving said polymer, from a spinneret into a non coagulative gas to give spun filaments, introducing said filaments into a coagulation bath to extract the acid contained in said filaments, neutralizing the filaments, washing the filaments, adjusting a water content of the filaments to not more than 100%, applying a pretension to the filaments at an optional stage after introduction into a coagulation bath and before heat treatment, and heat treating the filaments at a temperature of not less than 500° C. under a certain tension to give the fiber. The polybenzazole fiber of the present invention has a specific fine structure of fiber, as mentioned above, and also has a high tensile strength and a high tensile modulus heretofore unavailable. The inventive polybenzazole fiber can be manufactured at an industrial scale with ease. Thus, the inventive fiber is tremendously effective in expanding the field of possible utilization as an industrial material with high practical advantages.

13 Claims, 4 Drawing Sheets

Sample-to-detector distance : 293mm

Sample-to-detector distance : 293mm

POLYBENZAZOLE FIBER HAVING HIGH TENSILE MODULUS AND PROCESS OF MANUFACTURE THEREOF

TECHNICAL FIELD OF THE INVENTION

The present invention relates to a polybenzazole fiber having a markedly superior tensile modulus and an adequate strength as an industrial material.

BACKGROUND OF THE INVENTION

A polybenzazole fiber has tensile strength and tensile modulus twice or more greater than those of polyparaphenylene terephthalamide fiber which is a representative super fiber currently available in the market. Thus, this fiber is expected to be a next generation super fiber.

This fiber has been known to be obtained from a polyphosphoric acid solution of polybenzazole polymer. For example, spinning conditions are technically disclosed in U.S. Pat. No. 5,296,185 and U.S. Pat. No. 5,385,702, washing with water and drying is technically disclosed in WO94/04726, and heat treatment is technically disclosed in U.S. Pat. No. 5,296,185.

The tensile modulus of a high tensile strength polybenzazole fiber prepared by the above-mentioned conventional production method only reaches 290 GPa at most, even by a heat treatment at a temperature of not less than 350° C. as disclosed in U.S. Pat. No. 5,296,185. Despite the extremely high tensile modulus reported to have been achieved in a laboratory, yarn (collective filaments) having a tensile strength of not less than 5.0 GPa and a tensile modulus of not less than 290 GPa cannot be readily produced at an industrial level, except for an isolated case where molecular relaxation was suppressed under specific spinning conditions (Japanese Patent Unexamined Publication No. 325840/1996).

Thus, the present invention aims at providing a technique enabling easy production of a polybenzazole fiber having an ultimate tensile modulus as an organic fiber material.

An ultimate property of a fiber has been captured using a rigid polymer such as a so-called ladder polymer. Such rigid polymer, however, has no flexibility. For flexibility and processability of an organic fiber to be achieved, a linear polymer should be essentially used.

As suggested by S. G. Wierschke et al. in Material Research Society Symposium Proceedings, vol. 134, p.313 (1989), a linear polymer having the highest theoretical tensile modulus is a cis-type polyparaphenylene benzobisoxazole. This has been confirmed by Tashiro et al. in Macromolecules, vol. 24, p.3706 (1991). It has been considered that, of a series of polybenzazole polymers, a cis-type polyparaphenylene benzobisoxazole has an ultimate primary structure, since it has a crystal modulus of 475 GPa (P. Galen et al., Material Research Society Symposium Proceedings, vol. 134, p.329 (1989)). Therefore, a theoretical conclusion will be to use polyparaphenylene benzobisoxazole as a polymer to achieve an ultimate tensile modulus.

This polymer can be made into a fiber by the method described in U.S. Pat. No. 5,296,185 and U.S. Pat. No. 5,385,702, and a heat treatment is applied by the method described in U.S. Pat. No. 5,296,185. The yarn thus obtained has a tensile modulus of 290 GPa at most, which corresponds to only 61% of the theoretical crystal modulus. Further studies done by the present inventors in an attempt to provide a fiber having properties closer to the theoretical values have resulted in a polybenzazole fiber having a higher tensile strength and a higher tensile modulus, as well as a process for easy manufacture of the fiber at an industrial scale.

SUMMARY OF THE INVENTION

Accordingly, the present invention provides the following.

(1) A polybenzazole fiber obtained through a heat treatment, which has a high tensile modulus of not less than 300 GPa and a tensile strength of not less than 5.0 GPa, said fiber being characterized by at least one of the following (a) and (b) of an X-ray analysis of a fine structure thereof:

(a) a crystal orientation parameter $<\sin^2\Phi>$ of not more than 0.009 as determined by a wide-angle X-ray diffraction method, (b) absence of an equatorial streak, a two-point pattern or a four-point pattern in a small-angle X-ray scattering.

(2) The polybenzazole fiber of (1) above, wherein the crystal orientation parameter $<\sin^2\Phi>$ is not more than 0.007.

(3) The polybenzazole fiber of (1) above, which is characterized in that said fiber before heat treatment shows a convex inflection point of the square of scattering vector, $k^2$, in the range of 0.004–0.02 ($Å^{-2}$) in the Guinier plot obtained from an equatorial streak in the small-angle X-ray scattering.

(4) The polybenzazole fiber of (3) above, wherein said fiber before heat treatment has the crystal orientation parameter $<\sin^2\Phi>$ as determined by a wide-angle X-ray diffraction method of less than 0.025.

(5) A process of manufacturing the polybenzazole fiber of (1) above, which comprises the steps of (a) extruding a dope comprising a polybenzazole polymer and a nonoxidative acid capable of dissolving said polymer, from a spinneret into a non-coagulative gas to give dope filaments, (b) introducing said filaments into a coagulation bath to extract the acid contained in said filaments, (c) neutralizing the filaments, (d) washing the filaments, (e) adjusting a water content of the filaments to not more than 100%, and (f) heat treating the filaments at a temperature of not less than 500° C. under a certain tension to give the fiber.

(6) The process of (5) above, wherein the filaments before heat treatment has a water content of4–100%.

(7) The process of (6) above, wherein the filaments before heat treatment has a water content of 10–50%.

(8) The process of (5) above, wherein the filaments are placed under a tension of not less than 1.0 GPa at a certain stage after introduction into a coagulation bath and before heat treatment.

(9) The process of (8) above, wherein the filaments are placed under a tension of not less than 1.0 GPa before water content adjustment.

(10) The process of (9) above, wherein the tension is 2.8–4.2 GPa

(11) The process of (5) above, wherein the coagulation bath contains a nonaqueous coagulant.

(12) The process of (11) above, wherein the nonaqueous coagulant is selected from the group consisting of aldehyde, ketone, alcohol having 10 or less carbon atoms and a mixed solvent thereof.

(13) The process of (12) above, wherein the nonaqueous coagulant is selected from the group consisting of ethanol, methanol propanol, butanol, ethylene glycol, acetone and a mixed solvent thereof.

DETAILED DESCRIPTION OF THE INVENTION

Figure 1:
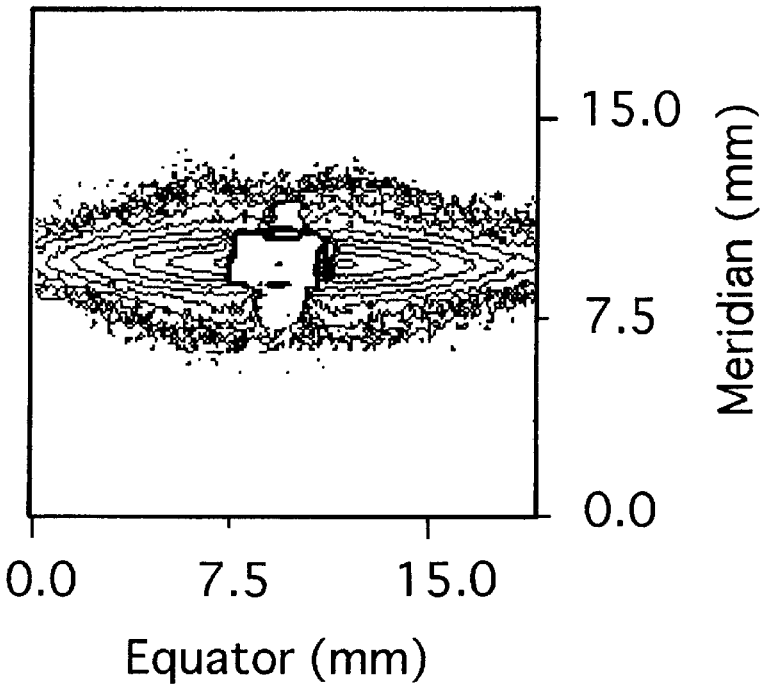
FIGS. 1(*a*) and 1(*b*) show small-angle X-ray scattering images of never-dried polybenzazole fibers before heat treatment, wherein FIG. 1(*a*) shows application of tension and FIG. 1(*b*) shows absence of tension.
Figure 1:
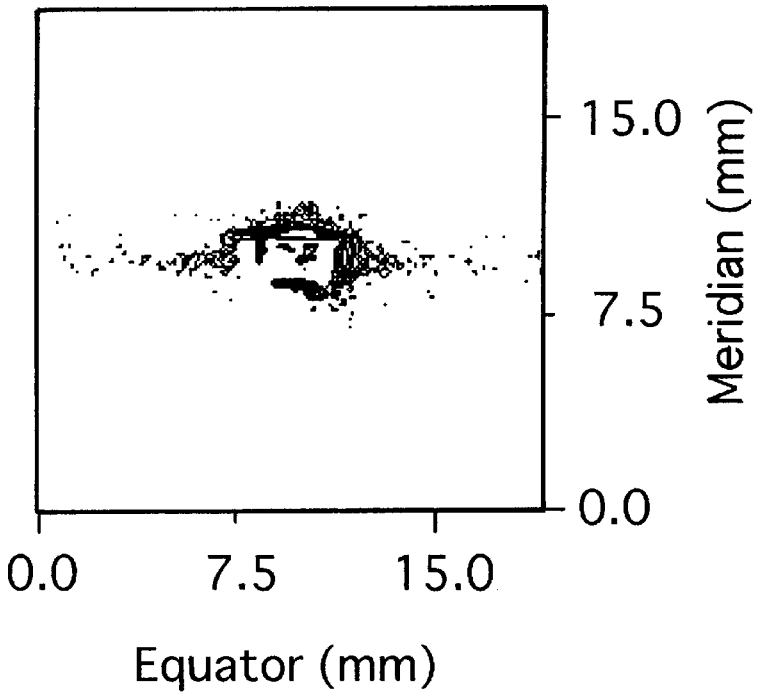

The present invention is described in more detail in the following. The polybenzazole fiber of the present invention refers to a fiber made from a polybenzazole (hereinafter also referred to as PBZ) polymer. The PBZ polymer includes polyparaphenylene benzobisoxazole (hereinafter also referred to as PBO) homopolymer, and random, sequential and block copolymers with other PBZ component, which substantial contain PBO component in a proportion of not less than 85 wt %. As used herein, the PBZ polymer is disclosed in, for example, Wolfe et al., Liquid Crystalline Polymer Compositions, Process and Products, U.S. Pat. No. 4,703,103, Oct. 27, 1987; Liquid Crystalline Polymer Compositions, Process and Products, U.S. Pat. No. 4,533,692, Aug. 6, 1985; Liquid Crystalline Poly(2,6-Benzothiazole) Composition, Process and Products, U.S. Pat. No. 4,533,724, Aug. 6, 1985; and Liquid Crystalline Polymer Compositions, Process and Products, U.S. Pat. No. 4,533,693, Aug. 6, 1985; Evers, Thermooxidatively Stable Articulated p-Benzobisoxazole and p-Benzobisthiazole Polymers, U.S. Pat. No. 4,539,567, Nov. 16, 1982; Tasi et al., Method for Making Heterocyclic Block Copolymer, U.S. Pat. No. 4,578,432, Mar. 25, 1986; and others.

The structural unit contained in the PBZ polymer is preferably selected from lyotropic liquid crystalline polymers. Said polymer comprises monomer unit(s) selected from the following formulas (a) to (h), more preferably, substantially the monomer unit(s) selected from the following formulas (a) to (d):

(a)

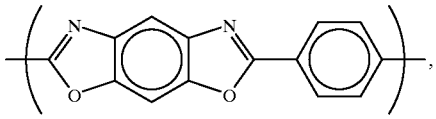

(b)

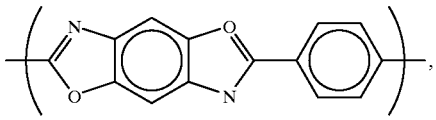

(c)

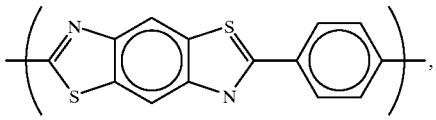

-continued (d)

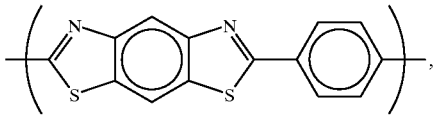

(e)

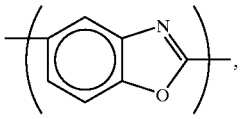

(f)

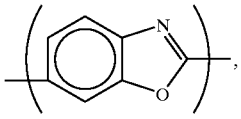

(g)

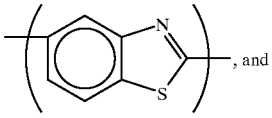

, and (h)

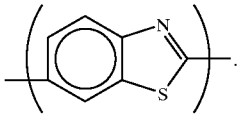

The polybenzazole fiber of the present invention has achieved a high tensile modulus of 300 GPa, preferably 350 Gpa, and high tensile strength of 5.0 GPa, preferably 6.5 GPa, due to the specific non-conventional fine structure of the fiber. In addition, industrial production has been made feasible.

The fine structure of the inventive polybenzazole fiber is characterized by a noticeably high crystal orientation as compared to conventional fibers, and high uniformity and regularity. These characteristics can be determined by an X-ray analysis.

The X-ray analysis to determine the fine structure of the inventive polybenzazole fiber may be a wide-angle X-ray diffraction or a small-angle X-ray scattering.

In the case of wide-angle X-ray diffraction, the inventive polybenzazole fiber obtained through heat treatment has a tensile modulus of not less than 300 GPa, a tensile strength of not less than 5.0 Gpa, and a crystal orientation parameter $\langle \sin^2\Phi \rangle$ to be mentioned later of not more than 0.009. The crystal orientation parameter is determined from a diffraction intensity distribution coefficient along the azimuthal direction on (200) plane diffraction measured by a wide-angle X-ray diffraction, as mentioned later. A smaller value means a higher crystal orientation in the fiber axis direction.

The polybenzazole fiber of the present invention has a high crystal orientation that has not been achieved heretofore, and a crystal orientation parameter $\langle \sin^2\Phi \rangle$ of preferably not more than 0.007.

For the inventive polybenzazole fiber to show a high crystal orientation, the crystal orientation of the polybenzazole fiber before heat treatment is preferably made as high as possible, and the crystal orientation parameter of the polybenzazole fiber before heat treatment is preferably less than 0.025.

In the case of small-angle X-ray scattering, the inventive polybenzazole fiber obtained through heat treatment, which has a tensile modulus of not less than 300 GPa and a tensile strength of not less than 5.0 GPa, does not show any of an equatorial streak, a two-point pattern and a four-point pattern. The fine structure of the fiber shown by the small-angle X-ray scattering is uniform in the fiber axis direction and shows a high crystal orientation. This fine structure has not been found in conventional polybenzazole fibers and is unique.

The polybenzazole fiber before heat treatment preferably shows a convex inflection point in the range of 0.004–0.02 ($Å^{-2}$) of the square of scattering vector, $k^2$, in a Guinier plot constructed from the equatorial streak in a small-angle X-ray scattering. The fine structure of the fiber indicated by such small-angle X-ray scattering consists of microfibrils having a uniform diameter, which constitute the fiber and are arranged regularly and in an exact order in the direction perpendicular to the axis of the fiber, namely, the direction of diameter of the fiber.

Such polybenzazole fiber has a fine structure with high orientation, uniformity and regularity. Thus, it can easily express the properties of high tensile modulus and high tensile strength. The fiber can achieve a tensile modulus of not less than 350 GPa and a tensile strength of not less than 6.2 GPa.

A process of manufacturing the specific inventive polybenzazole fiber having a fine structure and a high tensile modulus is explained in the following.

The manufacture process of polybenzazole fiber basically includes the steps of extruding a dope comprising a polybenzazole polymer and a nonoxidative acid capable of dissolving said polymer, from a spinneret into a non-coagulative gas to give spun (dope) filaments, introducing said filaments into a coagulation (extraction) bath to extract the acid contained in said filaments, neutralizing the filaments, washing the filaments, adjusting the water content of the filaments (drying), and heat-treating the filaments.

The process of manufacture of a polybenzazole fiber having a high crystal orientation, as demonstrated by a crystal orientation parameter $<\sin^2\Phi>$ of not more than 0.009, is explained in the following by referring to a fiber substantially made from polyparaphenylene benzobisoxazole.

A suitable solvent for preparing a dope of polymer substantially consisting of PBO is exemplified by cresol and non-oxidative acid capable of dissolving the polymer. Examples of suitable acid solvent include polyphosphoric acid, methanesulfonic acid, high conc. sulfuric acid, and mixtures thereof. More preferred are polyphosphoric acid and methanesulfonic acid, and most preferred is polyphosphoric acid.

The polymer concentration of the dope is at least about 7% by weight, more preferably at least 10% by weight, and most preferably at least 14% by weight. The maximum concentration thereof is limited by actual handling property such as solubility of polymer and viscosity of the dope. Due to such limiting factors, the polymer concentration of the dope does not generally exceed 20% by weight.

A suitable polymer, copolymer and dope are synthesized by a known method. For example, the methods described in Wolfe et al., U.S. Pat. No. 4,533,693 (Aug. 6, 1985), Sybert et al., U.S. Pat. No. 4,772,678 (Sep. 20, 1988), Harris, U.S. Pat. No. 4,847,350 (Jul. 11, 1989), and others are used. According to Gregory et al., U.S. Pat. No. 5,089,591 (Feb. 18, 1992), a polymer substantially consisting of PBO can be made to have a high molecular weight at a high reaction rate under the conditions of comparatively high temperature and high shear in a dehydrative acid solvent.

The dope thus prepared is supplied to a spinning part and delivered from a spinneret generally at a temperature of not less than 100° C. into a non-coagulative gas. The spinneret generally contains small holes arranged in plurality to form a circle, lattice or other shape. The number of small holes of a spinneret is not particularly limited, but the array thereof on the surface of the spinneret needs to have certain hole density so that mutual adhesion of delivered filaments would not occur.

The spun filaments require a sufficiently long draw zone to achieve a sufficient spin draw ratio (SDR), as described in U.S. Pat. No. 5,296,185. In addition, it is preferably uniformly cooled with commutated cooling air at a relatively high temperature higher than solidifying temperature of dope and lower than spinning temperature). The length (L) of the draw zone is the length necessary for the completion of solidification in a non-coagulative gas. It is roughly determined by single-hole delivery quantity (Q). For superior fiber properties, the filaments need to be cooled to a temperature not more than 50° C., preferably not more than 45° C., and brought into contact with the coagulant. When it exceeds 50° C., the crystal orientation of the fiber is not sufficiently improved due to a relaxation effect. In addition, the take up stress to be applied in the draw zone needs to be not less than 2 g/d when converted to polymer, namely, when polymer alone is subjected to the stress.

The filaments drawn in the draw zone are then led to an extraction (coagulation) bath. Due to high spinning tension, disturbance in extraction bath requires no attention, and the exaction bath may be of any type. For example, funnel type, water tank type, aspirator type or waterfall type bath may be used. The extraction solution (coagulant) is preferably an aqueous solution of phosphoric acid, water, methanol, ethanol, acetone, ethylene glycol and the like, which have no substantial compatibility with polybenzazole. Ultimately, not less than 99.0%, preferably not less than 99.5%, of the phosphoric acid contained in the filaments is extracted in the extraction bath. The extraction (coagulation) bath may be divided into multiple baths having gradually decreasing concentrations of the aqueous solution of phosphoric acid and finally water to wash the fiber. The filament bundle (filaments) is preferably neutralized with an aqueous solution of sodium hydroxide and the like and washed with water.

The filaments after washing with water are immediately dried to adjust water content to not more than 100% and wound up. In so doing, water contained in the filaments is preferably adjusted to 100%–4%, more preferably 50%–10%, most preferably 40%–15%, before heat treatment to achieve high tensile modulus in the next heat treatment. The water content of the filaments before heat treatment is adjusted by leaving the filaments in an electric oven, by passing the fiber on a drying roll or other method which is generally known.

When the filaments before heat treatment contain water at 100% or more, the substantial temperature of the filaments does not sufficiently rise during heat treatment, and desired properties cannot be afforded. On the other hand, when the water content is less than 4%, the above step is not enough to sufficiently improve the crystal orientation. The water only attached to the surface of PBO fiber is not effective.

The PBO fiber is considered to consist of polymer crystals. Water in the fiber is considered to be divided finely and present in an amorphous part or a space called capillary between crystals. It is postulated that it functions as a plasticizer in the heat treatment and promotes crystal orientation in the direction of the axis of the fiber.

The fiber thus produced surprisingly has a crystal orientation parameter of not more than 0.009, preferably not more than 0.007, and more preferably not more than 0.005, as determined by wide-angle X-ray diffraction. The indexing of the diffraction point used in the invention followed the crystal model proposed by Fratini et al. (Material Research Society Symposium Proceedings vol. 134, p.431 (1989)).

The uniform fine structure having a high crystal orientation free of equatorial streak (streak-like scattering in the direction perpendicular to the axis of the fiber), two-point pattern or four-point pattern, in small-angle X-ray scattering, can be realized by the application of a certain tension to the filaments. The tension is applied in an optional stage after introducing the filaments into a coagulation (extraction) bath and before heat treatment in the above-mentioned basic steps.

The tension to be applied is not less than 1.0 GPa, preferably not less than 2.8 GPa. The tension is applied by a general industrial method. For example, a tension is applied between Godet rolls having different rotation speeds. This treatment is effective when applied to a dry fiber completely without water, but more effectively applied to a fiber before drying when the fiber contains water, solvent or non-solvent. To be specific, the treatment is done during or after passage through extraction (coagulation) bath, during or after passage through neutralization bath, during or after passage through a step of washing with water, or during drying step (water content adjustment). The time for applying the tension is any as long as it is not less than 0.00001 second. This treatment of an extremely short time is sufficient to exert a superior effect. In particular, when applied to never-dried filaments, the effect is remarkable. In general, when the filaments lose water, the time necessary for rearranging the mole structure (changes in fine structure) tends to become longer. The rearrangement of molecular structure accompanying the tension treatment before heat treatment is markedly detectable. In a small-angle X-ray scattering, a strong equatorial streak that appears when the fiber contains capillary voids which generally arise during the coagulation step, substantially disappears. The tension necessary for causing the rearrangement of the molecular structure has a threshold value. An extremely high tension of not less than 1.0 GPa, more preferably 2.8 GPa4.2 GPa, is preferable. FIG. 1 shows comparison of small-angle X-ray scattering images with or without application of tension to never-dried fibers.

Figure 2:
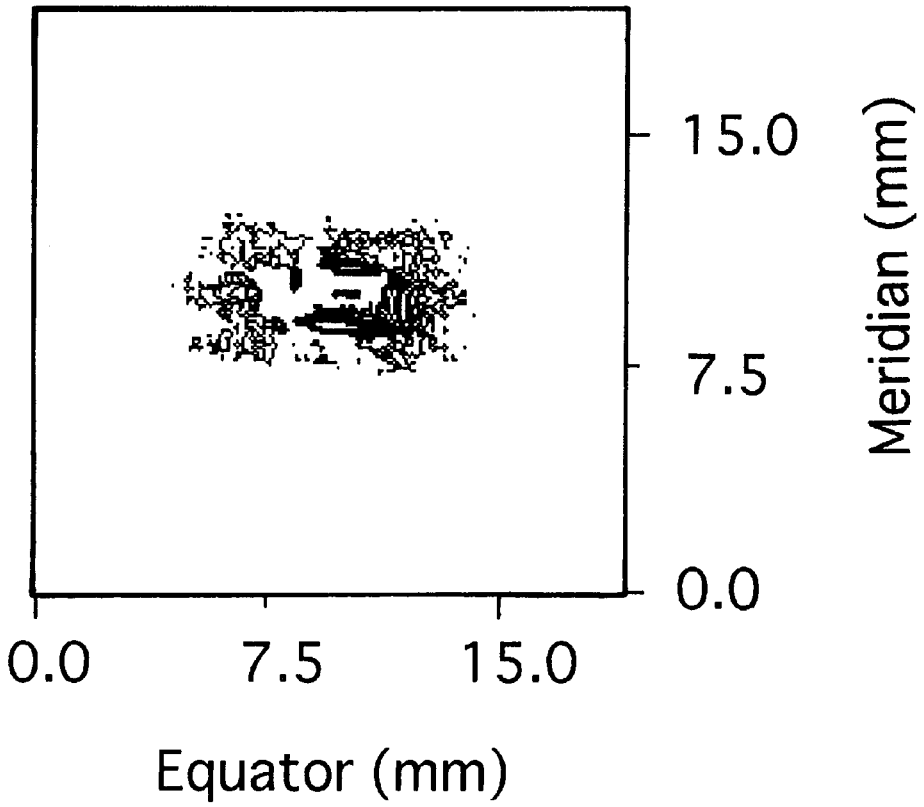
FIG. 2 shows a specific small-angle X-ray scattering image of the inventive polybenzazole fiber after heat treatment.

The fiber obtained by the process described above is a polybenzazole fiber free of an equatorial streak (streak-like scattering in the direction perpendicular to the axis of the fiber) in a small-angle X-ray scattering and having a fiber density of not more than 1.55 g/cm$^3$. When the fiber density exceeds 1.55 g/cm$^3$, uniform alignment of molecular chains in the direction of axis of the fiber is difficult to achieve. It is preferably 1.52–1.55 g/cm$^3$. The fiber after molecular rearrangement is subjected to heat treatment. In this way, a polybenzazole fiber having a high tensile strength and a high tensile modulus, which have not been conventionally achieved, can be produced. Surprisingly, a small-angle X-ray scattering of the fiber after heat treatment has been found to be free of a four-point pattern or a two-point pattern reported in, for example, Japanese Patent Unexamined Publication No. 325840/1996, S. J. Bai et al., Polymer, vol.33 p.2136 (1992) and S. Kumar et al., Polymer, vol.35 p.5408 (1991). Not to mention, an equatorial streak does not exist. The small-angle X-ray scattering image of the inventive polybenzazole fiber after heat treatment is shown in FIG. 2. This finding has not been reported in any patent or literature. The fine structure found in the inventive polybenzazole fiber is an academically novel structure.

Moreover, to make the diameter of microfibrils constituting the fiber uniform and to provide a fine structure comprising microfibrils arranged regularly in the direction perpendicular to the axis of the fiber, a nonaqueous solvent that is substantially free of compatibility with polybenzazole is used for a coagulation bath.

In general, a fiber achieves a high tensile modulus by increasing the crystal orientation in the fiber. For this end, the dope filaments are coagulated while maintaining the high orientation of molecular chain in the draw zone. When water or aqueous phosphoric acid solution is used as a coagulant as in prior art technique, however, infiltration speed (diffusion speed) of water molecule into the dope filaments during coagulation becomes too fast to cause disturbance of fine structure once formed in the draw zone. As a result, a high tensile modulus cannot be achieved by a conventional method including washing with water, neutralization, drying and heat treatment under tension. In the present invention, dope filaments are cooled to not more than 50° C., preferably not more than 45° C., and the filaments are introduced into a coagulation bath containing a nonaqueous coagulant. As a result, the dope filaments are coagulated to give a fiber, without losing the high orientation afforded in the draw zone. The fine structure of the fiber thus obtained is characterized by the uniform diameter of the microfibril constituting the fiber and regular arraignment thereof in the direction perpendicular to the axis of the fiber, as compared to conventional production methods. In addition, a heat treatment of the fiber under a tension results in easy manufacture of a fiber having a higher tensile strength and a higher tensile modulus.

The nonaqueous coagulant is preferably aldehyde, ketone, alcohol having 10 or less carbon atoms or a mixed solvent thereof, and more preferably ethanol, methanol, propanol, butanol, ethylene glycol, acetone or a mixed solvent thereof. By finally washing the filaments with water after coagulation, the phosphoric acid contained in the filaments is extracted by not less than 99.0% , preferably not less than 99.5%. The coagulation bath may be divided into multiple baths and the filaments may be finally washed with water. For an improved arrangement of microfibrils and crystal orientation of the filaments after coagulation, a tension may be applied to the filaments containing polyphosphoric acid, coagulant, neutralizing agent or water, during or between coagulation, washing with water, neutralization and drying. It is also preferable that a filament bundle be neutralized with an aqueous solution of sodium hydroxide and the like and washed with water.

Figure 3:
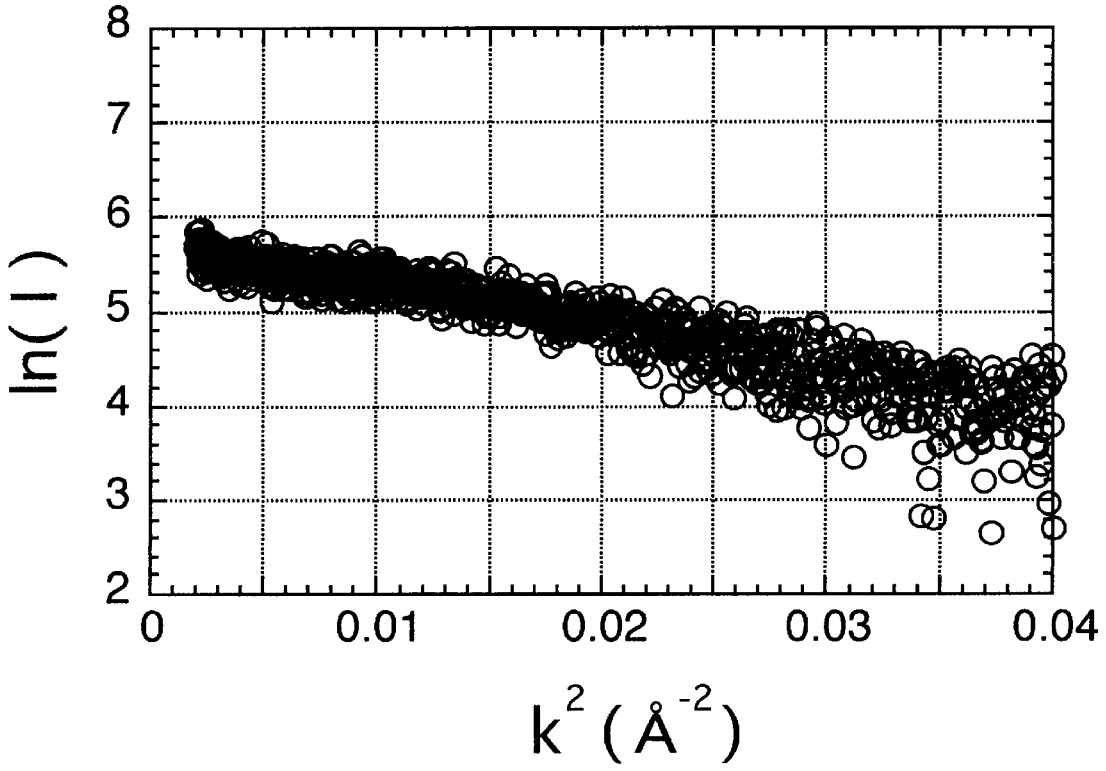
FIG. 3 shows a Guinier plot showing a dependence on scattering angle in a small-angle X-ray scattering of the polybenzazole fiber prepared by a conventional method, which is after water washing and before drying (water content adjustment).
Figure 4:
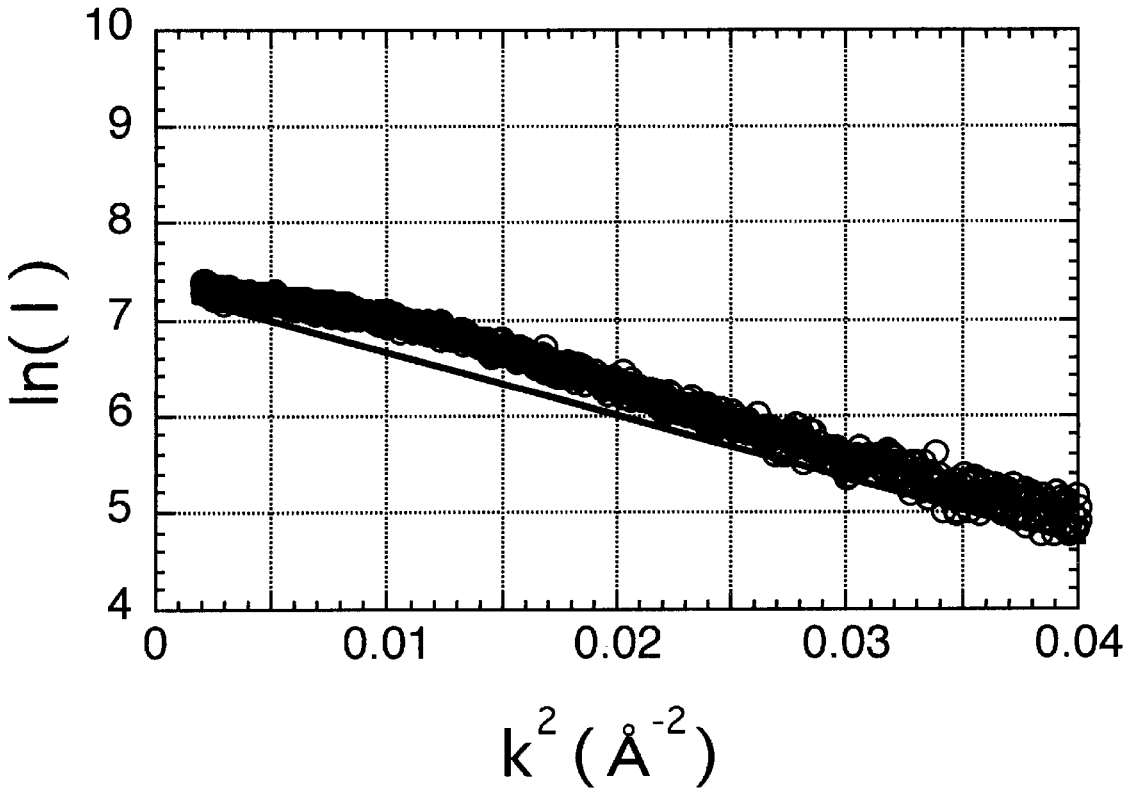
FIG. 4 shows a Guinier plot showing a dependence on scattering angle in a small-angle X-ray scattering of the polybenzazole fiber prepared by the inventive process, which is after water washing and before drying (water content adjustment).

The use of a nonaqueous coagulation liquid which has no substantial compatibility with polybenzazole makes the inventive process distinct from the conventional methods using water or an aqueous solution of phosphoric acid as a coagulant, in terms of the fine structure of filaments after water washing. That is, when a small-angle X-ray scattering image of filaments after water washing is measured by the method to be mentioned later, an equatorial streak occurs. The dependence of the scattering intensity on the scattering angle is characteristic. FIG. 3 shows a Guinier plot showing a dependence on scattering angle in a small-angle X-ray scattering of the polybenzazole fiber prepared by a conventional method after water washing and before drying (water content adjustment), and FIG. 4 shows a Guinier plot showing a dependence on scattering angle in a small-angle X-ray scattering of the polybenzazole fiber prepared by the inventive process after water washing and before drying (water content adjustment). A clear convex inflection point appears in the range of 0.004–0.02 ($Å^{-2}$) of the square of scattered vector, $k^2$, in the Guinier plot of the fiber prepared by the process of the present invention. According to the theory of small-angle X-ray scattering, the convex inflection point is considered to be due to the regular arrangement of microfibrils constituting the fine structure of the fiber, in the direction perpendicular to the axis of the fiber. It is needless to say that a fine structure of the fiber after washing prepared by a conventional method also consists of microfibrils. As shown in FIG. 3, however, the Guinier plot is characterized by the absence of inflection point along a linear line in a wide range of $0.003<k^2<0.04$ ($Å^{-2}$). This means that the fiber after water washing, which is prepared by the process of the present invention, has a fine structure characterized by a uniform diameter of microfibrils and regular arrangement thereof in the direction perpendicular to the axis of the fiber.

The crystal orientation of the filaments washed with water was determined and compared by the method to be described later. As a result, the fiber filament after water washing, which was prepared by a conventional method, had a crystal orientation parameter $<\sin^2\Phi>$ of not less than 0.025, whereas that of the fiber filaments prepared by the inventive process was less than 0.025. Therefore, the crystal orientation of the spun filaments prepared by the process of the present invention is higher than by the conventional method.

The filaments after water washing were dried and heated at a temperature not less than 500° C. under a certain tension. In this way, filaments having a tensile modulus of not more than 300 GPa and a tensile strength of not less than 5.0 GPa can be obtained. The result is attributable to the inventive coagulation method that is free of disturbance of the fine structure due to the coagulation. The characteristic fine structure of the fiber after water washing is an essential pre-structure that will mature into a fiber having high tensile modulus and high tensile strength after the next heat treatment.

Measurement of crystal orientation parameter

The measurement method of wide-angle X-ray diffraction and evaluation of crystal orientation parameter $<\sin^2\Phi>$ are explained in detail in the following. A rotating anode type X-ray generator (RU-200, manufactured by Rigaku Co., Ltd.) was used as an X-ray source, and the output was run on tube voltage 40 kV, tube current 100 mA. The anode was copper and a CuK $\alpha$ ray monochromatized with a nickel filter was taken out using a 3-slit point-collimated small-angle X-ray scattering equipment (manufactured by Rigaku Co., Ltd.). At this time, the pinhole diameter of the first slit was 0.2 mm and that of the second slit pinhole was 0.15 mm. The fiber filaments were exposed to X-ray thus taken out. The diffracted X-ray from the fiber was detected using an imaging plate (FDL UR-V, Fuji Photo Film Co., Ltd.) placed at 80 mm behind the fiber filament (reverse direction from X-ray source). The time necessary for the determination to obtain sufficient intensity of diffraction was 20 min to 120 min. The intensity of diffraction detected on the imaging plate was analyzed by PIXsysTEM20 (manufactured by JEOL LTD.) using a digital micrography (FDL5000, Fuji Photo Film Co., Ltd.). The distribution of the intensity of diffraction in the azimuthal direction along the Debye ring on the (200) plane diffraction was compensated for background scattering, and the crystal orientation parameter was calculated by the following formula $$\langle \sin^2\phi \rangle = \frac{\int_0^{\pi/2} I(\phi)\sin^3\phi d\phi}{\int_0^{\pi/2} I(\phi)\sin\phi d\phi}$$

wherein $I(\Phi)$ is the azimuthal distribution of intensity of diffraction after compensation of background scattering along the Debye ring on the (200) plane and $\Phi$ is the azimuthal angle measured from the equator.

<Measurement method of small-angle X-ray scattering>

The small-angle X-ray scattering was measured by the following method. The X-ray source was generated by Rotaflex RU-300 manufactured by Rigaku Co., Ltd. The copper anode was used as a target and the generator was run on a fine focus at output 30 kV×30 mA. The optical system used was a point-focusing camera manufactured by Rigaku Co., Ltd. and X-ray was monochromatized using a nickel filter. The detector was an imaging plate (FDL UR-V, Fuji Photo Film Co., Ltd.). The distance between the sample and detector was optional and varied from 200 mm to 350 mm. Helium gas was filled between the sample and detector to inhibit background scattering from air and the like. The exposure time was 2–24 hours. The scattering intensity recorded on the imaging plate was read by a digital micrography (FDL5000, Fuji Photo Film Co., Ltd.). The obtained data was compensated for the background scattering and the Guinier plot was drawn relative to the intensity (I) of scattering in the equatorial direction. That is, a natural logarithm of intensity of scattering, ln(I), after compensation of background scattering was plotted against the square of scattering vector, $k^2$. As used herein, scattering vector k was $k=(4\pi/\lambda)\sin\theta$, $\lambda$ was wavelength 1.5418 Å of X-ray, $\theta$ is a half of scattering angle $2\theta$.

Water content

The water content of the fiber was measured using a weight method. That is, the fiber to be the target of the water content measurement was weighed using a chemical balance and the fiber was left in an electric oven adjusted to 230° C. for 30 minutes, which was followed by weighing. The water content was the proportion (wt %) of water evaporated from the fiber to the fiber weight after evaporation of water.

Density

The density was measured using a dry type automatic densitometer Accupyc (picnometer using helium gas) manufactured by Micromeritics.

Tensile strength, elongation at break and tensile modulus of fiber

Measured according to the method and conditions defined in JIS L 1013 (1981).

Fineness of fiber

The temperature was adjusted to 20° C. and humidity was set to 65% RH. The test fiber (10 m) was wound up on a wrap reel and weighed. This was converted to the weight of 9000 m.

The present invention is described in more detail by way of Examples and Comparative Examples, to which the invention is not limited.

EXAMPLE 1

A spinning dope comprising polyparaphenylene benzobisoxazole (14.0 wt %) and polyphosphoric acid containing phosphorus pentaoxide (83.17%), which was obtained by the method disclosed in U.S. Pat. No. 4,533,693 and which had an intrinsic viscosity as measured using a methanesulfonic acid solution at 30° C. of 24.4 dL/g, was used. The dope was filtered through a metal mesh and kneaded and defoamed in a twin-screw kneader. The pressure was raised and the dope was spun from a spinneret having 34 holes at 170° C. while maintaining the dope temperature at 170° C. Then, the delivered filaments were cooled with cooling air at 60° C. and further cooled natural to 40° C. The filaments were led into a coagulation bath containing water at 25±2° C. The filaments were wound on a Godet roll and washed in the second exaction bath containing ion exchange water at a certain speed. The filaments were immersed in a 0.1N sodium hydroxide solution for neutralization. The filaments were washed with water, wound up, dried in a dry oven at 80° C. to a water content of 25%. The filaments were heated at 600° C. under a tension of 7.0 g/d for 2.4 seconds to give a fiber.

EXAMPLE 2

In the same manner as in Example 1 except that the water content upon drying was set to 7%, a fiber was obtained.

EXAMPLE 3

In the same manner as in Example 1 except that the water content upon drying was set to 82%, a fiber was obtained.

COMPARATIVE EXAMPLE 1

The same manner as in Example 1 except that the water content upon drying was set to 121%, a fiber was obtained.

COMPARATIVE EXAMPLE 2

In the same manner as in Example 1 except that the water content upon drying was set to 3%, a fiber was obtained.

COMPARATIVE EXAMPLE 3

In the same manner as in Example 1 except that the water content upon drying was set to 1% and dried, and water was attached to the filament by a kiss roll until the water content was 21%, a fiber was obtained.

The properties of the fibers obtained in Examples 1 to 3 and Comparative Examples 1 to 3 are shown in Table 1. In the following Tables, fiber properties without specific indication were measured after heat treatment

TABLE 1

| | unit | Ex. 1 | Ex. 2 | Ex. 3 | Com. Ex. 1 | Com. Ex. 2 | Com. Ex. 3 |
|---|---|---|---|---|---|---|---|
| Spinning conditions | | | | | | | |
| Delivery quantity (Q) | CC/min | 42.3 | 42.3 | 42.3 | 42.3 | 42.3 | 42.3 |
| Orifith diameter | mm | 0.2 | 0.2 | 0.2 | 0.2 | 0.2 | 0.2 |
| Number of filaments | filaments | 34 | 34 | 34 | 34 | 34 | 34 |
| Air gap length | mm | 850 | 850 | 850 | 850 | 850 | 850 |
| Spinning speed | m/min | 300 | 300 | 300 | 300 | 300 | 300 |
| Spin draft ratio | | 49 | 49 | 49 | 49 | 49 | 49 |
| Fiber properties | | | | | | | |
| Finness | denier | 50 | 50.1 | 49.9 | 50.0 | 50.3 | 49.9 |
| Tensile strength | GPa | 5.1 | 5.8 | 6.4 | 5.1 | 5.9 | 5.3 |
| Tensile modulus | % | 401 | 378 | 351 | 276 | 281 | 273 |
| Elongation at break | g/cm$^3$ | 1.8 | 1.9 | 2.0 | 2.3 | 2.2 | 2.4 |
| Fiber density before heat treatment | g/cm$^3$ | 1.54 | 1.54 | 1.54 | 1.54 | 1.54 | 1.54 |
| Fiber density after heat treatment | | 1.56 | 1.56 | 1.56 | 1.56 | 1.56 | 1.56 |
| Crystal orientation parameter before heat treatment | | 0.0422 | 0.0404 | 0.0411 | 0.0407 | 0.0431 | 0.0422 |
| Crystal orientation parameter after treatment | | 0.00391 | 0.00412 | 0.00458 | 0.00717 | 0.00733 | 0.00751 |

It is evident from the above Table 1 that the fiber of the present invention showed remarkable improvements in tensile strength and tensile modulus, as compared to conventional fibers. The inventive fibers are extremely superior in properties. It has been also confirmed that they have a specific fine structure.

EXAMPLES 4–6

A spinning dope comprising polyparaphenylene benzobisoxazole (14.0 wt %) and polyphosphoric acid containing phosphorus pentaoxide (83.17%), which was obtained by the method disclosed in U.S. Pat. No. 4,533,693 and which had an intrinsic viscosity as measured using a methanesulfonic acid solution at 30° C. of 24.4 dL/g, was used. The dope was filtered through a metal mesh and kneaded and defoamed in a twin-screw kneader. The pressure was raised and the dope was spun from a spinneret having 166 holes at 170° C. while maintaining the dope temperature at 170° C. Then, the delivered filaments were cooled with cooling air at 60° C. and led into a coagulation bath containing 20% aqueous phosphoric acid solution at 20±2° C. The filaments were wound on a Godet roll, given a spinning speed and washed in the second extraction bath containing ion exchange water. The filaments were immersed in a 0.1N sodium hydroxide solution for neutralization. During or after water washing the filaments, a tension under the conditions (pretension) shown in Table 2 was applied. The filaments were wound up, dried in a dry oven at 80° C. to a water content of not more than 2%. The fiber was heated at 600° C. under a tension of 7.0 g/d for 1.4 seconds to give a fiber.

COMPARATIVE EXAMPLES 4–7

In the same manner as in Example 4 except that the conditions of application of tension were changed to those in Table 2, a fiber was obtained. The properties of the fibers obtained in Examples 4–6 and Comparative Examples 4–7 are shown in Table 2.

TABLE 2

| | unit | Ex. 4 | Ex. 5 | Ex. 6 | Com. Ex. 4 | Com. Ex. 5 | Com. Ex. 6 | Com. Ex. 7 |
|---|---|---|---|---|---|---|---|---|
| Spinning conditions | | | | | | | | |
| Delivery quantity (Q) | CC/min | 42.3 | 42.3 | 42.3 | 42.3 | 42.3 | 42.3 | 42.3 |
| Orifith diameter | mm | 0.2 | 0.2 | 0.2 | 0.2 | 0.2 | 0.2 | 0.2 |
| Number of filaments | filaments | 166 | 166 | 166 | 16600 | 166 | 166 | 166 |
| Air gap length | mm | 1550 | 1550 | 1550 | 1550 | 1550 | 1550 | 1550 |
| Spinning speed | m/min | 400 | 400 | 400 | 400 | 400 | 400 | 400 |
| Spin draft ratio | | 49 | 49 | 49 | 49 | 49 | 49 | 49 |
| Pretension | GPa | 3.0 | 3.0 | 2.4 | 0.0 | 0.0 | 1.5 | 0.7 |
| Duration time for pretension | second | 1.0 | 0.1 | 0.1 | 0.0 | 0.0 | 0.1 | 1.0 |
| Pretension treatment | | after water washing | after water washing | during washing | none | none | after heat treatment | after water washing |
| Fiber properties | | | | | | | | |
| Fiber density before heat treatment | g/cm$^3$ | 1.54 | 1.54 | 1.54 | 1.54 | 1.54 | 1.56 | 1.53 |
| Finness | denier | 249 | 248 | 250 | 250 | 250 | 249 | 250 |
| Tensile strength | GPa | 5.2 | 5.8 | 6.2 | 6.0 | 5.0 | 5.8 | 5.2 |
| Tensile modulus | % | 402 | 346 | 322 | 280 | 162 | 285 | 283 |
| Elongation at break | g/cm$^3$ | 1.8 | 1.9 | 2.1 | 2.4 | 3.6 | 2.3 | 2.2 |
| Small-angle X-ray scattering image | | none | none | none | four-point pattern | equatorial streak | four-point pattern | two-point pattern |
| Fiber density before heat treatment | g/cm$^3$ | 1.54 | 1.54 | 1.54 | 1.54 | 1.54 | 1.56 | 1.53 |
| Fiber density after heat treatment | | 1.57 | 1.56 | 1.56 | 1.56 | 1.55 | 1.56 | 1.56 |
| Crystal orientation parameter before heat treatment | | 0.0251 | 0.0252 | 0.0252 | 0.0411 | 0.0399 | 0.0421 | 0.0401 |
| Crystal orientation parameter after treatment | | 0.00591 | 0.00613 | 0.00613 | 0.00774 | 0.00231 | 0.00921 | 0.00918 |

It is evident from the above Table 2 that the fiber of the present invention showed remarkable improvements in tensile strength and tensile modulus, as compared to conventional fibers. The inventive polybenzazole fibers are extremely superior in properties. It has been also confirmed that they have a specific fine structure.

EXAMPLES 7–10, COMPARATIVE EXAMPLES 8–11

A spinning dope comprising polyparaphenylene benzobisoxazole (14.0 wt %) and polyphosphoric acid containing phosphorus pentaoxide (83.17%), which was obtained by the method disclosed in U.S. Pat. No. 4,533,693 and which had an intrinsic viscosity as measured using a methanesulfonic acid solution at 30° C. of 24.4 dL/g, was used. The dope was filtered through a metal mesh and kneaded and defoamed in a twin-screw kneader. The a pressure was raised and the dope was spun from a spinneret having 34 holes at 170° C. while maintaining the dope temperature at 170° C. Then, the delivered filaments were cooled with cooling air at 60° C. and further cooled natural to 40° C. The filaments were led into a coagulation bath containing coagulants listed in Table 3 at 30±2° C. The filaments were led into a coagulation bath containing 20% aqueous phosphoric acid solution at 20±2° C. The filaments were wound on a Godet roll, given a spinning speed and washed in the second extraction bath containing ion exchange water. The filaments were immersed in a 0.1N sodium hydroxide solution for neutralization. The filaments were washed with water, wound up, dried in a dry oven at 80° C. to a water content of not more than 2%. The filaments were heated at 600° C. under a tension of 7.0 g/d for 1.4 seconds to give a fiber. The results are shown in Table 3.

TABLE 3

| | unit | Ex. 7 | Ex. 8 | Ex. 9 | Ex. 10 | Com. Ex. 8 | Com. Ex. 9 | Com. Ex. 10 | Com. Ex. 11 |
|---|---|---|---|---|---|---|---|---|---|
| Spinning conditions | | | | | | | | | |
| Delivery quantity (Q) | CC/min | 42.3 | 42.3 | 42.3 | 42.3 | 42.3 | 42.3 | 42.3 | 42.3 |
| Orifith diameter | mm | 0.2 | 0.2 | 0.2 | 0.2 | 0.2 | 0.2 | 0.2 | 0.2 |
| Number of filaments | filaments | 33 | 33 | 33 | 33 | 33 | 33 | 33 | 33 |
| Air gap length | mm | 850 | 850 | 850 | 850 | 850 | 850 | 850 | 850 |
| Spinning speed | m/min | 300 | 300 | 300 | 300 | 300 | 300 | 300 | 300 |
| Spin draft ratio | — | 49 | 49 | 49 | 49 | 49 | 49 | 49 | 49 |
| Filament temperature before heat treatment | ° C. | 40 | 40 | 40 | 40 | 60 | 40 | 40 | 40 |

TABLE 3-continued

| | unit | Ex. 7 | Ex. 8 | Ex. 9 | Ex. 10 | Com. Ex. 8 | Com. Ex. 9 | Com. Ex. 10 | Com. Ex. 11 |
|---|---|---|---|---|---|---|---|---|---|
| Coagulant | | metha-nol | ethanol | ethylene glycol | cetone | ethanol | water | 50% aq. ethanol | 20% aq. phospholic acid |
| Fiber properties | | | | | | | | | |
| Finness | denier | 49.3 | 48.8 | 51.2 | 51.2 | 50.0 | 50.3 | 49.9 | 49.9 |
| Tensile strength | GPa | 5.2 | 6.3 | 5.7 | 5.5 | 5.0 | 6.0 | 5.0 | 5.8 |
| Tensile modulus | GPa | 390 | 403 | 373 | 394 | 283 | 280 | 274 | 277 |
| Elongation at break | % | 1.8 | 1.9 | 2.1 | 2.1 | 2.1 | 2.4 | 2.2 | 2.3 |
| Fiber density before heat treatment | $g/cm^3$ | 1.54 | 1.54 | 1.54 | 1.54 | 1.54 | 1.54 | 1.54 | 1.54 |
| Fiber density after heat treatment | $g/cm^3$ | 1.56 | 1.56 | 1.56 | 1.56 | 1.56 | 1.56 | 1.56 | 1.56 |
| Crystal orientation parameter before heat treatment | | 0.023 | 0.022 | 0.024 | 0.023 | 0.034 | 0.041 | 10.033 | 0.038 |
| Crystal orientation parameter after treatment | | 0.00593 | 0.00589 | 0.00599 | 0.00592 | 0.00713 | 0.00823 | 0.00765 | 0.00774 |
| Inflection point in Guinier plot before heat treatment | | present | present | present | present | none | none | none | none |

It is evident from the above Table 3 that the polybenzazole fiber of the present invention showed remarkable improvements in tensile strength and tensile modulus, as compared to conventional fibers. It has been also confirmed that the polybenzazole fiber before heat treatment has a specific fine structure.

The polybenzazole fiber of the present invention has a specific fine structure of fiber, as mentioned above, and also has a high strength and a high tensile modulus heretofore unavailable. The inventive polybenzazole fiber can be manufactured at an industrial scale with ease. Thus, the inventive fiber is tremendously effective in expanding the field of possible utilization as an industrial material with high practical advantages. That is, the fiber can be used for a wide range of uses, inclusive of tension material such as cable, electric wire, optical fiber and rope; aviation and space materials such as rocket insulation, rocket casing, pressure container, string of space suit and planet probe balloon; impact resistant material such as bulletproof material; cutproof materials such as gloves; heat resistant flame resistant material such as fire resistant suit, heat resistant felt, gasket for plant, heat resistant knit fabric, various sealings, heat resistant cushion and filter; rubber reinforcing material for belt, tire, sole, rope, hose and the like; sport-related material such as fishing line, fishing rod, tennis racket, table tennis racket, badminton racket, golf shaft, club head, gut, string, sail cloth, athletic shoes, running shoes, spiked shoes, skating shoes, game bicycle and wheel thereof, road racer, piste racer, mountain bike, composite wheel, disc wheel, tension disc, spoke, braking wire, transmission wire, game wheelchair and wheel thereof, protector, ski, stock, helmet and parachute; fiction resistant material and clutch facing, reinforcing agents for various building materials; and various other uses such as rider suit, speaker cone, lightweight baby carriage, lightweight wheelchair, lightweight medical care bed, life boat, life jacket and the like.

This application is based on application Nos. 161554/1997 and 280789/1997 filed in Japan, the contents of which are incorporated hereinto by reference.

What is claimed is:

1. A polybenzazole fiber obtained through a heat treatment, said fiber having a tensile modulus of not less than 300 GPa and a tensile strength of not less than 5.0 GPa, said fiber having at least one of the following properties are determined by an X-ray analysis of a fine structure of said fiber:

(1) a crystal orientation parameter $<\sin^2\Phi>$ of not more than 0.009 as determined by a wide-angle X-ray diffraction method, and (2) absence of an equatorial streak, a two-point pattern or a four-point pattern in a small-angle X-ray scattering.

2. The polybenzazole fiber of claim 1, wherein the crystal orientation parameter $<\sin^2\Phi>$ is not more than 0.007.

3. The polybenzazole fiber of claim 1, wherein said fiber before heat treatment shows a convex inflection point of the square of a scattering vector, $k^2$, in the range of 0.004–0.02 ($Å^{-2}$) in a Guinier plot obtained from an equatorial streak in the small-angle X-ray scattering.

4. The polybenzazole fiber of claim 3, wherein said fiber before heat treatment has the crystal orientation parameter $<\sin^2\Phi>$ as determined by a wide-angle X-ray diffraction method of less than 0.025.

5. A process of manufacturing the polybenzazole fiber of claim 1, comprising:

(a) extruding a dope from a spinneret into a non-coagulative gas to produce dope filaments, wherein said dope comprises a polybenzazole polymer and a nonoxidative acid capable of dissolving said polymer, (b) introducing the filaments into a coagulation bath to extract the acid contained in said filaments, (c) neutralizing the filaments, (d) washing the filaments, (e) adjusting a water content of the filaments to not more than 100%, and (f) heat treating the filaments at a temperature of not less than 500° C. under a certain tension to produce the polybenzazole fiber.

6. The process of claim 5, wherein the filaments before heat treatment has a water content of4–100%.

7. The process of claim 6, wherein the filaments before heat treatment has a water content of 10–50%.

8. The process of claim 5, wherein the filaments are placed under a tension of not less than 1.0 GPa at a certain stage after introducing the filaments into the coagulation bath and before heat treating the filaments at the temperature of not less than 500° C.

9. The process of claim 8, wherein the filaments are placed under a tension of not less than 1.0 GPa before adjusting the water content of the filaments to not more than 100%.

10. The process of claim 9, wherein the tension is 2.8–4.2 GPa.

11. The process of claim 5, wherein the coagulation bath contains a nonaqueous coagulant.

12. The process of claim 11, wherein the nonaqueous coagulant is selected from the group consisting of aldehyde, ketone, alcohol having 10 or less carbon atoms and a mixed solvent thereof.

13. The process of claim 12, wherein the nonaqueous coagulant is selected from the group consisting of ethanol, methanol, propanol, butanol, ethylene glycol, acetone and a mixed solvent thereof.

* * * * *